US005434210A

United States Patent [19]

Rangaswamy et al.

[11] Patent Number: 5,434,210

[45] Date of Patent: * Jul. 18, 1995

[54] THERMAL SPRAY POWDERS FOR ABRADABLE COATINGS, ABRADABLE COATINGS CONTAINING SOLID LUBRICANTS AND METHODS OF FABRICATING ABRADABLE COATINGS

[75] Inventors: Subramaniam Rangaswamy, Rochester Hills; Robert A. Miller, Oak Park, both of Mich.

[73] Assignee: Sulzer Plasma Technik, Inc.

[ * ] Notice: The portion of the term of this patent subsequent to Mar. 23, 2010 has been disclaimed.

[21] Appl. No.: 952,023

[22] Filed: Sep. 28, 1992

Related U.S. Application Data

[63] Continuation of Ser. No. 615,557, Nov. 19, 1990, Pat. No. 5,196,471.

[51] Int. Cl.[6] ..... C08K 3/08

[52] U.S. Cl. ..... 524/406; 524/413; 524/418; 524/419; 524/420; 524/439; 524/440; 524/441; 524/497; 523/204; 523/207; 523/209; 428/403; 428/404; 428/407

[58] Field of Search ..... 524/404, 406, 413, 418, 524/419, 420, 436, 439, 440, 441, 492, 493, 497; 523/204, 207, 209; 428/403, 404, 407

[56] References Cited

U.S. PATENT DOCUMENTS

| | | | |
|---|---|---|---|
| 3,084,064 | 4/1967 | Cowden et al. | 428/457 |
| 3,419,363 | 12/1968 | Sliney . | |
| 3,508,955 | 4/1970 | Sliney et al. . | |
| 3,879,831 | 4/1975 | Rigney et al. | 428/231 |
| 3,953,343 | 4/1976 | Sliney | 252/12 |
| 4,136,211 | 1/1979 | Sliney | 427/34 |
| 4,214,905 | 7/1980 | Sliney | 75/200 |
| 4,269,903 | 5/1981 | Clingman et al. | 428/591 |
| 4,664,973 | 5/1987 | Otfinoski et al. | 428/407.3 |
| 4,728,448 | 3/1988 | Sliney | 252/12.2 |
| 4,867,639 | 9/1989 | Strangman | 415/173.4 |
| 5,196,471 | 3/1993 | Rangasuamy et al. | 524/406 |

FOREIGN PATENT DOCUMENTS 8802031 5/1989 WIPO .

OTHER PUBLICATIONS

Series of Abstracts: Abstract Nos. 5 and 30; No. 4 and No. 8.

*Primary Examiner*—Paul R. Michl
*Assistant Examiner*—Edward J. Cain
*Attorney, Agent, or Firm*—Dykema Gossett

[57] ABSTRACT

Thermal spray powders are characterized by the presence of a matrix-forming component, a solid lubricant component and a plastic component. Abradable coatings formed by thermal spraying the powders abrade readily to form abradable seals. The abradable coatings have a metal, metal alloy, or ceramic matrix with discrete inclusions of solid lubricant and plastic. The thermal spray powders may be prepared as mechanically fused agglomerates.

42 Claims, 3 Drawing Sheets

THERMAL SPRAY POWDERS FOR ABRADABLE COATINGS, ABRADABLE COATINGS CONTAINING SOLID LUBRICANTS AND METHODS OF FABRICATING ABRADABLE COATINGS

This application is a continuation of U.S. patent application Ser. No. 07/615,557 filed Nov. 19, 1990, now U.S. Pat. 5,196,471.

TECHNICAL FIELD

The present invention relates generally to composite abradable coatings which are fabricated using thermal spray processes. More specifically, this invention relates to composite abradable coatings and thermal spray powders of the type having a solid lubricant component.

BACKGROUND OF THE INVENTION

Materials which abrade readily in a controlled fashion are used in a number of applications, including as abradable seals. As will be appreciated by those skilled in the art, contact between a rotating part and a fixed abradable seal causes the abradable material to erode in a configuration which closely mates with and conforms to the moving part at the region of contact. In other words, the moving part wears away a portion of the abradable seal so that the seal takes on a geometry which precisely fits the moving part, i.e., a close clearance gap. This effectively forms a seal having an extremely close tolerance.

One particular application of abradable seals is their use in axial flow gas turbines. The rotating compressor or rotor of an axial flow gas turbine consists of a plurality of blades attached to a shaft which is mounted in a shroud. In operation, the shaft and blades rotate inside the shroud. The inner surface of the turbine shroud is most preferably coated with an abradable material. The initial placement of the shaft and blade assembly in the shroud is such that the blade tips are as close as possible to the abradable coating.

As will be appreciated by those skilled in the art, it is important to reduce back flow in axial flow gas turbines to maximize turbine efficiency. This is achieved by minimizing the clearance between the blade tips and the inner wall of the shroud. As the turbine blades rotate, however, they expand somewhat due to the heat which is generated. The tips of the rotating blades then contact the abradable material and carve precisely defined grooves in the coating without contacting the shroud itself. It will be understood that these grooves provide the exact clearance necessary to permit the blades to rotate at elevated temperatures and thus provide an essentially custom-fitted seal for the turbine.

In other gas turbines, the initial clearance is somewhat greater and the abradable coating is intended to protect the shroud and blade tips against wear during transient conditions (e.g., power surges).

In order for the turbine blades to cut grooves in the abradable coating, the material from which the coating is formed must abrade relatively easily without wearing down the blade tips. This requires a careful balance of materials in the coatings. In this environment, an abradable coating must also exhibit good resistance against particle erosion and other degradation at elevated temperatures. As known by those skilled in the art, however, these desirable characteristics have been difficult to obtain.

A number of abradable coatings have been proposed by others. These include cellular or porous metallic structures, such as illustrated in U.S. Pat. Nos. 3,689,971, 4,063,742, 4,526,509, 4,652,209, 4,664,973, and 4,671,735. Low melting point metallic coatings of indium, tin, cadmium, lead, zinc, and aluminum alloys have been suggested for use in providing "ablative" seals wherein heat generated by friction melts a clearance gap in the coating. This approached is exemplified in U.S. Pat. Nos. 2,742,224 and 3,836,156. Still others have proposed the use of hard ceramics such as $ZrO_2$ and MgO for use in forming abradable coatings as shown in U.S. Pat. Nos. 4,405,284, 4,460,311, and 4,669,955.

In U.S. Pat. No. 3,508,955, a composite material is disclosed which comprises a porous metal impregnated with a fluoride of metals selected from Groups I and II of the Periodic Table of Elements. The use of fluoride salts and a barium fluoride-calcium fluoride eutectic is specifically mentioned as is the use of the material in bearings and seals. It is also disclosed therein that the resultant material can be sprayed with a surface layer of fluoride eutectic slurry which is then dried and sintered.

In U.S. Pat. No 4,867,639, abradable coatings for use in turbine or compressor shrouds are disclosed which are described as low melting fluoride compounds such as $BaF_2$, $CaF_2$ and $MgF_2$ incorporated into a higher melting temperature ceramic or metallic matrix. It is disclosed that, alternatively, the soft ceramic phase may be used to fill or impregnate a honeycomb shroud lining made of the higher melting temperature hard ceramic or metal alloy, so that the soft ceramic is not eroded by hot gases in the turbine. Zirconia and/or alumina are disclosed as the preferred high melting temperature ceramic, and NiCr and NiCrAl are disclosed as preferred metals.

The use of metal matrix coatings having a plastic component such as a polyimide are also known for use in forming an abradable seal in high-efficiency compressors. Due to the lower temperatures generated in the compressor and the fact that the rotating blades are generally softer than those found in the turbine section, plastics have been used in lieu of solid lubricants such as $CaF_2$. While the lower melting point of plastics is advantageous in such low temperature applications, the use of these coatings often results in the accumulation of residue on the rotating blades as well as a gradual increase in the gap between the blade and the coating because of thermal effects.

Therefore, it would be desirable to provide a composite material which abrades readily without producing significant wear of rotating parts.

It would also be desirable to provide such a material which can be fabricated using conventional thermal spray techniques.

It would still further be desirable to provide such a coating which could be used to form abradable seals in relatively low-temperature environments wherein the seal material does not adhere to rotating parts.

It would still further be desirable to provide a coating for forming abradable seals which can be custom formulated for a particular operating environment.

The present invention achieves these goals by providing thermal spray powders and composite coatings made with these powders which contain a matrix component, a solid lubricant component and a plastic component.

SUMMARY OF THE INVENTION

In one aspect, the present invention provides thermal spray powders which have at least three components, namely: a matrix-forming material which is either a metal, a metal alloy, or a ceramic material; a solid lubricant which is preferably more lubricious than the matrix-forming components; and a plastic. In one preferred embodiment, the thermal spray powders of the present invention are agglomerated particles comprising a central mass of plastic on which the matrix-forming and solid lubricant components are attached.

In another aspect, the present invention provides abradable materials, particularly abradable coatings, having a matrix portion in which a solid lubricant and a plastic are embedded. The matrix comprises either a metal, a metal alloy, or a ceramic. The solid lubricant is preferably a ceramic compound such as, for example, $CaF_2$, which is more lubricious than the matrix material. The plastic component is most preferably a polyimide. Numerous conventional thermal spray techniques can be used to form the coatings of the present invention.

These and other meritorious features and advantages of the present invention will be more fully explained in the following description of the preferred embodiment of the invention with reference to the following drawings:

DESCRIPTION OF THE PREFERRED EMBODIMENT

Figure 1:
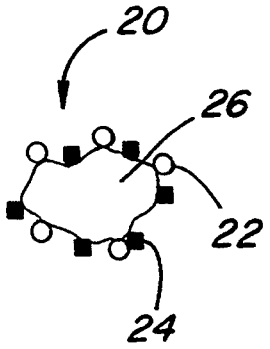
FIG. 1 illustrates an agglomerated thermal spray particle in accordance with the present invention.

In one embodiment, the present invention provides thermal spray powders for use in forming abradable materials such as coatings for turbine shrouds, compressor housings and other applications in which it is necessary to form an abradable seal. The thermal spray powders of the invention are characterized by the incorporation of three components comprising: a first material which forms a matrix or quasi-continuous phase; a second material which serves as a solid lubricant in the final coating; and a third material which is a plastic. As will be described more fully herein, the combination of a solid lubricant and a plastic distributed in a matrix provides a synergistic result which in abradable coatings have unexpected superior characteristics over prior art materials.

The first component, i.e., the material which forms a matrix for the other materials, is selected from the group consisting of metals, metal alloys, and ceramics. As used herein "ceramic" shall be defined as compounds of metallic and non-metallic elements.

Preferred metals for use as the matrix-forming component of the present invention may be selected from the group consisting of aluminum, titanium, copper, zinc, nickel, chromium, iron, cobalt and silicon. Alloys of these metals are also preferred for use as the first component of the present invention. Where the first component is a metal or a metal alloy, it comprises from about 10 to about 90 percent by weight, more preferably from about 20 to about 70 percent by weight and most preferably from 30 to about 50 percent by weight of the thermal spray powder.

Preferred ceramics for use as the matrix-forming component of the present invention may be selected from the group consisting of alumina, titania, fully or partially stabilized zirconia, multicomponent oxides, including titanates, silicates, phosphates, spinels, perovskites, machinable ceramics (e.g. Corning Macor TM ) and combinations thereof. Where the first component is a ceramic, it comprises from about 5 to about 90 percent by weight, more preferably from about 20 to about 70 percent by weight and most preferably from about 20 to about 40 percent by weight of the thermal spray powder.

Preferred solid lubricants for use as the second component of the present invention are ceramics, such as ceramic fluorides, sulfides and oxides, for example, $CaF_2$, $MgF_2$, $MoS_2$, $BaF_2$, and fluoride eutectics, such as $BaF_2/CaF_2$. Other solid lubricants such as hexagonal BN may also be suitable for use in the present invention. The solid lubricant ceramic comprises from about 1 to about 50 percent by weight, more preferably from about 1 to about 40 percent by weight and most preferably from about 1 to about 20 percent by weight of the thermal spray powder.

Preferred plastics for use as the third component of the present invention are thermoplastics, although it is anticipated that thermosetting plastics may be suitable in some applications. Plastics suitable for use in the present invention should not become brittle at service temperatures and should not abrade rotating surfaces which contact the final coating. The preferred plastics should withstand temperatures at least up to 250° F. without changes. It is believed that a broad range of molecular weights will be suitable. It is estimated that the weight average molecular weight of suitable plastics may range from approximately 500 to 1,000,000, although other values may also be suitable in some instances. The molecular weight should provide the desired functional characteristics of the plastic component.

The preferred plastics are polyimides such as those described in U.S. Pat. Nos. 3,238,181, 3,426,098, 3,382,203, the disclosures of which are incorporated herein by reference, most preferably thermoplastic polyimides, polyamide-imides, polyetherimides, bismalemides, fluoroplastics such as PTFE, FEP, and PFA, ketone-based resins, also polyphenylene sulfide, polybenzimidazole aromatic polyesters, and liquid crystal polymers. Most preferred are imidized aromatic polyimide polymers and p-oxybenzoyl homopolyester such as disclosed in U.S. Pat. No. 3,829,406 and poly(-para-oxybenzoylmethyl) ester. Torlon TM and Ekonol TM are also preferred.

In some instances, graphite may be substituted for all or a portion of the plastic component in the present invention. With respect to the thermal spray powders of the present invention, a plastic comprises from about 5 to about 90 percent by weight, more preferably from about 20 to about 70 percent by weight and most preferably from about 30 to about 50 percent by weight of the thermal spray powder.

Although the most preferred thermal spray powders of the present invention are provided as agglomerates of the three materials, i.e., matrix-forming component, solid lubricant and plastic, alternatively, the powders of the present invention may comprise blends of discrete particles of each of the three components. In this alternative embodiment, segregation in storage and during spraying as well differential vaporization or oxidation of the components may produce less desirable coatings. Where the components are provided as blends of discrete particles, the matrix-forming component has an average particle size of from about 5 μm to about 125 μm if metallic, with the particles ranging in size from about 1 μm to about 150 μm; and from about 5 μm to about 125 μm if ceramic, with the particles size ranging from about 1 μm to about 150 μm. The solid lubricant has an average particle size of from about 1 μm to about 125 μm, with the particle size ranging up to about 150 μm; and the plastic has an average particle size of from about 5 μm to about 125 μm, with the particle size ranging from about 1 μm to about 150 μm.

The preferred agglomerates of the present invention are best described with reference to FIG. 1 of the drawings. Accordingly, agglomerate 20 is shown having particles of a first component 22, for example, an aluminum-silicon alloy, and a second component 24, i.e, a solid lubricant such as $CaF_2$, embedded in the surface of a third component 26 such as a polyimide. The first component serves, as previously described, as the matrix-forming component, while the solid lubricant and plastic render the coatings abradable. As previously discussed, the first component of the agglomerate is a metal, metal alloy or ceramic material; the second component is a solid lubricant, the first and second components being embedded in or attached to the surface of the third component, i.e., a plastic.

The first component comprises from about 5 to about 90 percent by weight; more preferably from about 20 to about 70 percent by weight; and most preferably from about 30 to about 50 percent by weight of agglomerate 20. The second component comprises from about 1 to about 50 percent by weight; more preferably from about 1 to about 40 percent by weight; and most preferably from about 1 to about 20 percent by weight of agglomerate 20. The third component comprises from about 5 to about 90 percent by weight; more preferably from about 20 to about 70 percent by weight; and most preferably from about 30 to about 50 percent by weight of agglomerate 20.

A number of methods of forming agglomerate 20 are suitable for use; however, particularly preferred is the mechanical fusion or agglomeration process set forth in co-pending U.S. patent application entitled, Binder-Free Agglomerated Powders, Their Method of Fabrication and Methods for Forming Thermal Spray Coatings, Ser. No. 07/615,771, which has been assigned by the assignee of the present invention and the entire disclosure of which is incorporated herein by reference.

Accordingly, the three components (matrix-forming constituent, solid lubricant and plastic) are placed in a rotatable drum in which at least one treatment member is suspended. The drum may be generally cylindrical, having a continuous curved inner wall. The treatment member has an impact surface which is positioned adjacent the continuous curved portion of the drum. The materials are processed in the chamber by being centrifugally forced against the continuous curved surface of the chamber, whereupon the materials move between the impact surfaces of the treating members and the continuous wall surface. Forces of shear and compression are thereby exerted on the materials, causing the materials to agglomerate. This effect can be enhanced by external heating (e.g. by a hot air gun). The resultant binder-free agglomerated particles are a composite of the three materials. In one embodiment, the treating member is rotated along the same direction as the rotation of the rotating chamber. Alternatively, the drum may be stationary with the treatment members rotating in the chamber to provide a similar result. The process parameters suitable for use in forming the thermal spray powders by this process are set forth more fully in the aforementioned co-pending application Ser. No. 07/615,771 which is incorporated herein by reference. It may also be desirable to form the agglomerates of the present invention by conventional agglomeration techniques such as through the use of an inorganic or organic binder.

In both of the above methods, the starting materials will generally be provided in the following size ranges: metal or metal alloy as the matrix-forming component—average particle size from about 5 μm to about 125 μm, with particles ranging in size from 1 μm to about 150 μm; ceramic as the matrix-forming component—average particle size from about 5 μm, to about 125 μm, with particles ranging in size from about 1 μm to about 150 μm; solid lubricant—average particle size from about 1 μm to about 125 μm, with particle size up to about 150 μm; and plastic—average particle size from about 5 μm to about 125 μm, with particles ranging in size from about 1 μm to about 150 μm.

Figure 2:
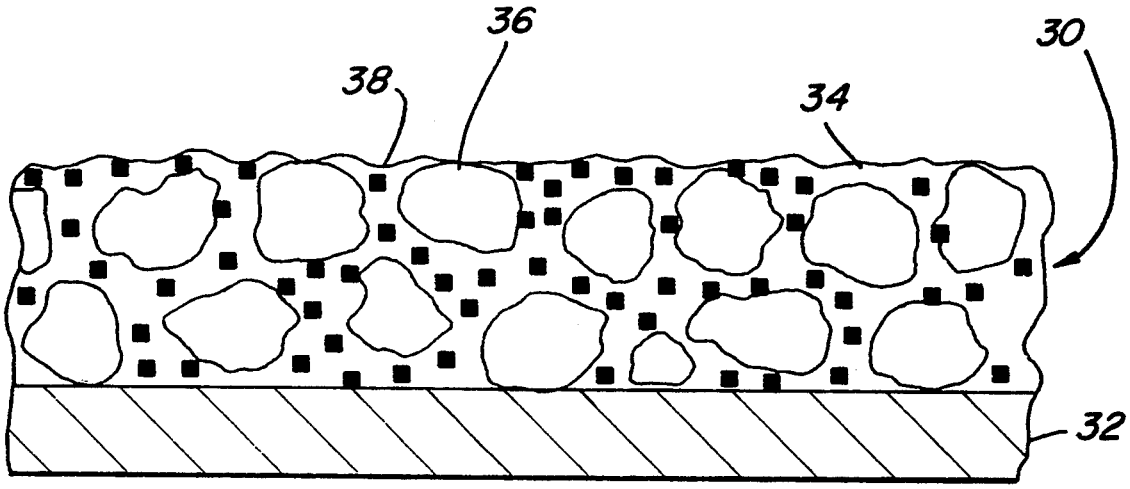
FIG. 2 is a diagramatic cross section of an abradable coating made in accordance with the present invention.

In still another embodiment, the present invention provides a method of forming an abradable coating and novel coatings fabricated using the thermal spray powders disclosed herein. With reference now to FIG. 2 of the drawings, coating 30 is shown deposited on substrate 32 which may comprise the inner wall of a compressor housing or the like. Coating 30 includes a matrix 34 formed of one of the above-mentioned preferred matrix-forming components such as an alloy of aluminum and silicon. Embedded in matrix 34, inclusions of one or more of the preferred plastics 36, such as a polyimide, are shown. Also embedded in matrix 34 are solid lubricant inclusions 38, for example $CaF_2$ particles. It is to be understood that matrix 34 is a quasi-continuous phase while plastic 36 and solid lubricant 38 are generally dispersed within matrix 34 as discrete particles or bodies.

A number of thermal spray devices and techniques can be used to form the abradable coatings of the present invention, including the apparatus and process disclosed in co-pending U.S. patent application Ser. No. 247,024, which was filed on Sep. 20, 1988, the entire disclosure of which is incorporated herein by reference.

By way of illustration only, a thermal spray powder having the characteristics described in connection with FIG. 1 of the drawings in which the matrix is AlSi, the solid lubricant is $CaF_2$ and the plastic is polyimide, is preferably thermal sprayed at a feed rate of about 20 to 70 g/min. Each agglomerate is preferably 20 to 50 percent by weight matrix-forming component; 1 to 20 percent by weight solid lubricant; and about 30 to 50 percent by weight plastic. The particles are sprayed using parameters suitable for the specific spray system. Parameters for the Plasma Technik F4 System TM, for our powder are showed in this table.

| Gun | F4 | F4 |
|---|---|---|

-continued

| | | | | |
|---|---|---|---|---|
| Plasma Gases | Argon-Hydrogen | | Helium-Argon | |
| Nozzle | 6 mm (Std) | | 6 mm (Std) | |
| Powder Injector | | | | |
| Size | 2 mm | | 2 mm | |
| Gauge | 6 mm | | 6 mm | |
| Angle | 105 degrees | | 105 degrees | |
| Disc (rpm) | 75* | | 75* | |
| Stirrer (rpm) | 80 | | 80 | |
| Spreader Assembly | SPL | | SPL | |
| Gases: | Pressure (bar) | Flow (L/min) | Pressure (bar) | Flow (L/min) |
| Primary | 3.0 | 70 Ar | 3.0 | 70 He |
| Secondary | 3.0 | 8 $H_2$ | 3.0 | 30 Ar |
| Carrier | 3.0 | 4.5 Ar | 3.0 | 5 Ar |
| Current (Amps) | 450 | | 450 | |
| Voltage (V) | approx. 67 | | approx. 50 | |
| Spray rate (lbs/hr) | 4.5–5 | | 4.5–5 | |
| Spray distance (inches) | 4 | | 3.5 | |

*As a starting point, adjust to indicated spray rate

It will be recognized that the morphology and composition of the particles, whether agglomerates or discrete particles, can change during the spray process because of thermal and kinetic effects. The solid lubricant inclusions in the final coating will typically be substantially smaller than the plastic inclusions, for example, having an average diameter of up to 50 μm. The plastic inclusion will typically have an average diameter of from about 5 to 124 μm. Both the solid lubricant and the plastic will be generally uniformly dispersed in the matrix. The relative proportions of the three components in the coating will generally fall within the preferred ranges set forth with respect to the portions of the materials in the agglomerates.

The spray parameters are not generally critical, but must be compatible with the characteristics of the thermal spray powders as well as sufficient to provide a final coating as described herein. Thus, the temperature and velocity should allow the matrix-forming component to fuse, forming a matrix. The conditions should be such that neither the plastic component nor the solid lubricant substantially thermally degrade or vaporize during spraying. The solid lubricant and plastic should also not segregate in the matrix, i.e., they should be generally randomly dispersed in the matrix. In use, the coatings of the present invention most preferably serve as abradable seals in turbine and compressor housings, although numerous other applications will be apparent to those skilled in the art. It may also be desirable to form near-net shape articles using the thermal spray powders of the present invention. It may also be desirable to intentionally oxidize or vaporize the plastic component prior to provide a more porous structure.

In some instances, it may be advantageous for the plastic component of the coating to be removed by thermal treatment prior to service or by thermal exposure in service, leaving a matrix phase containing uniformly distributed pores and solid lubricant inclusions.

A number of specific coatings (and thermal spray powders used to form the coatings) are provided by the present invention which are deemed particularly useful in forming abradable coatings. More specifically, the following combinations are particularly preferred (all percents by weight of powder, excluding binder material):

| Matrix-forming Component | | Solid Lubricant | | Plastic* | |
|---|---|---|---|---|---|
| AlSi | 45% | $CaF_2$ | 10% | Polyimide | 45% |
| CuAl | 70% | $CaF_2$ | 5% | Polyimide | 25% |
| CuNi | 70% | $CaF_2$ | 5% | Polyimide | 25% |
| Ni Alloy | 70% | $CaF_2$ | 5% | Polyimide | 25% |
| Fe Alloy | 70% | $CaF_2$ | 5% | Polyimide | 25% |
| Co Alloy | 65% | $MoS_2$ | 10% | Polyimide | 25% |
| Co Alloy | 65% | BN | 10% | Polyimide | 25% |
| CuNi Alloy | 70% | BaF2—CaF2 | 5% | Polyimide | 25% |

*May substitute aromatic polyester for all or part of polyimide

EXAMPLES

The following example is provided to more fully describe a preferred embodiment of the present invention, but is in no way intended to limit the present invention:

I.

Figure 3:
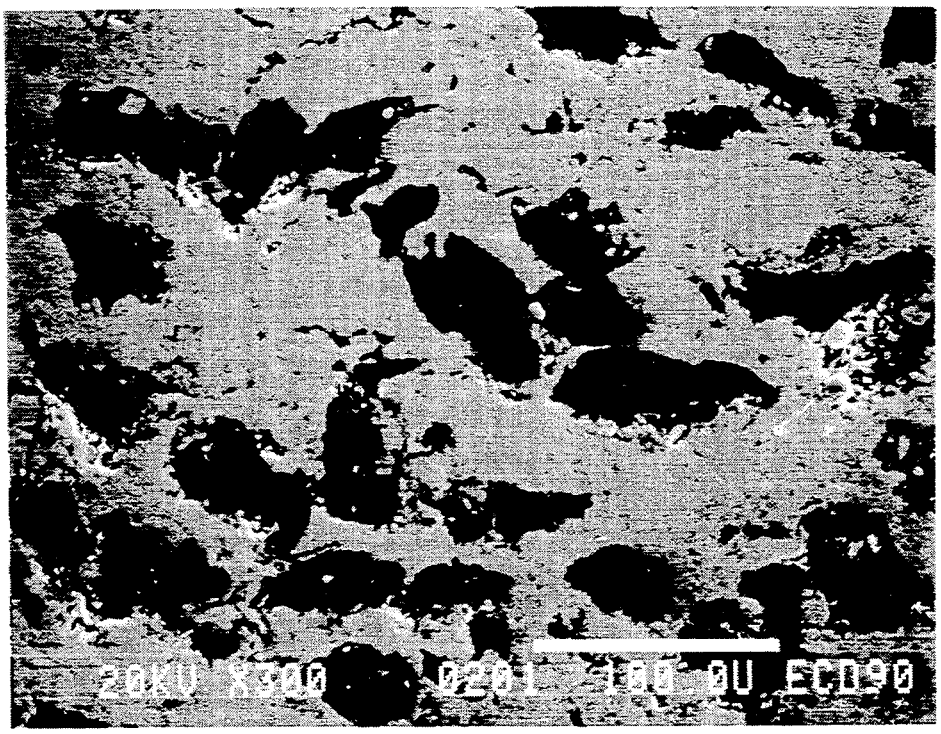
FIG. 3–5 are photomicrographs of an abradable coating made in accordance with the present invention.
Figure 4:
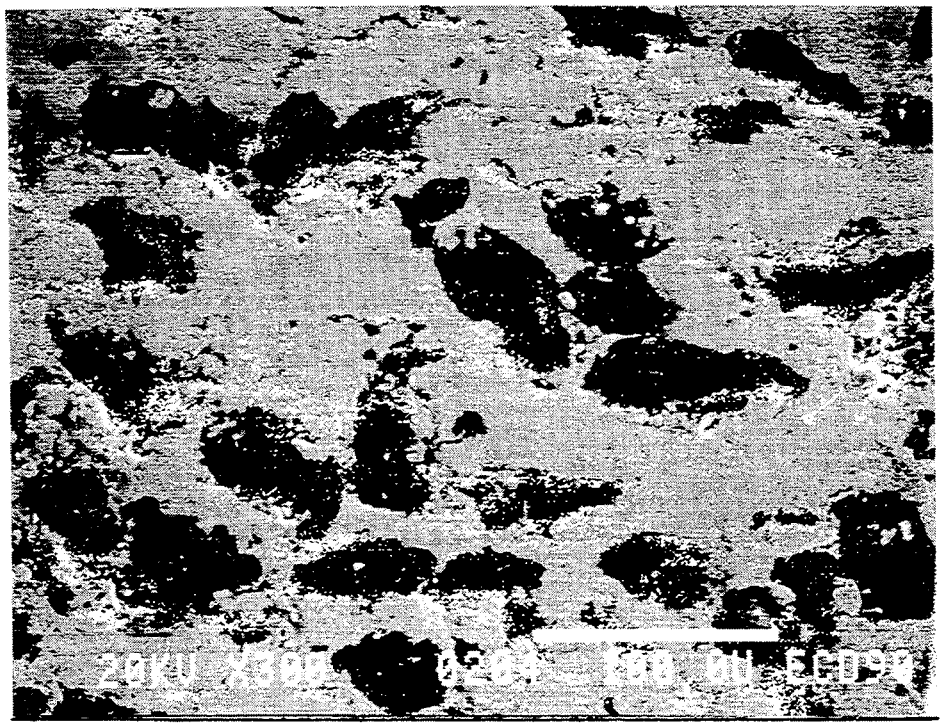
Figure 5:
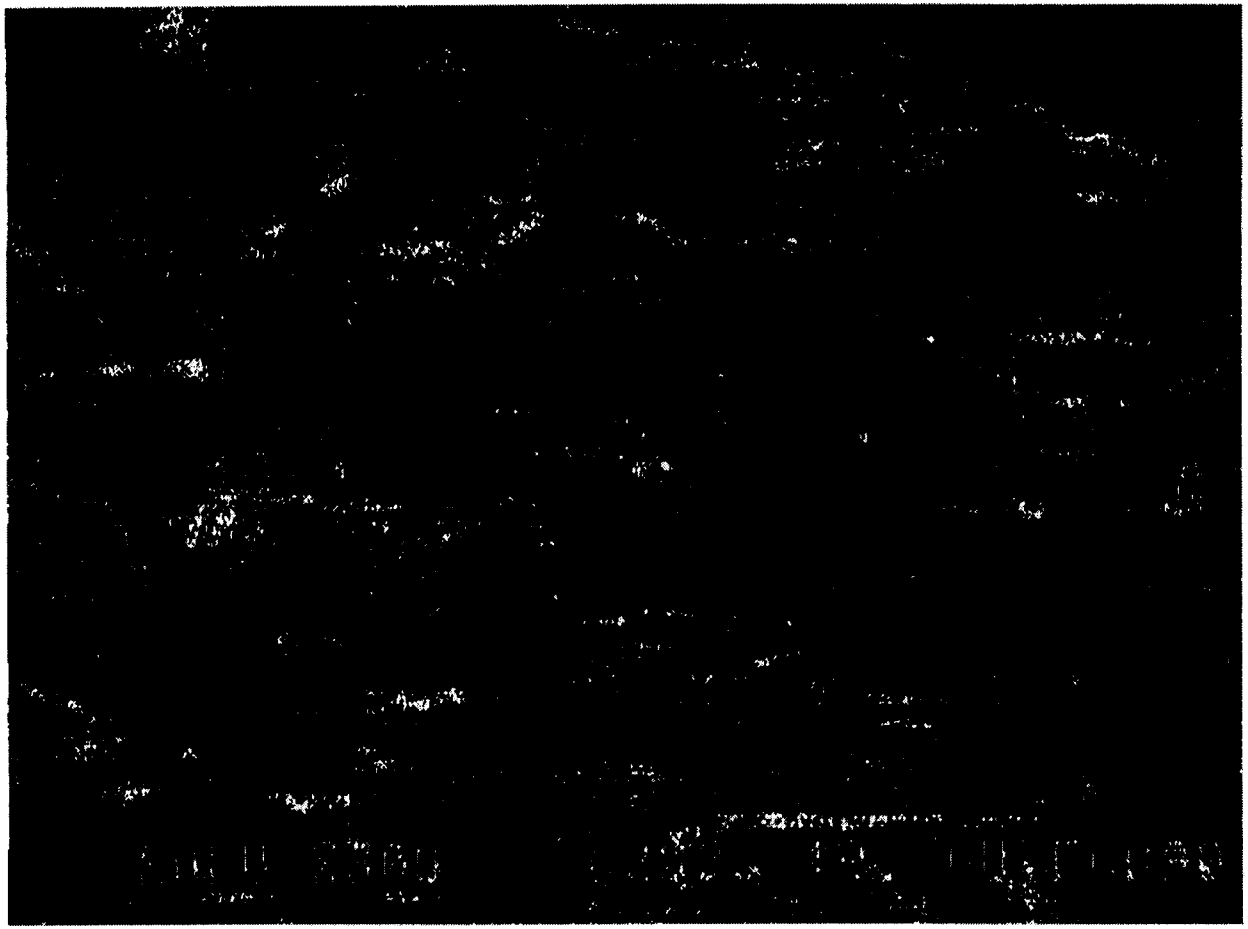

1,000 grams polyimide powder (−140/+325 mesh), 1,000 grams of AlSi alloy (12% by weight Si) powder (−270 mesh) and 220 grams of $CaF_2$ powder (approximately 2 μm) were added to a solvent blend containing 135 grams of organic binder. The ingredients were mixed at a temperature of about 300° F. until dry. The resulting agglomerates were removed and screened to yield a −70 mesh powder. The powder was plasma sprayed to form coatings on a low carbon steel substrate. FIGS. 3–5 are scanning electron photo micrographs of the resultant coatings. More specifically, in FIG. 3 large (mostly 44 to 105 μm) inclusions of polyimide are seen embedded in an AlSi matrix. In FIGS. 4 and 5, the coating has been subjected to radiation causing the $CaF_2$ particles to appear as bright dots, illustrating the presence of $CaF_2$ particles throughout the matrix. It will be noted that $CaF_2$ also attaches to the plastic bodies to some extent. The coatings were found to abrade readily.

What is claimed is:

1. A thermal spray powder which contains a matrix-forming component selected from the group consisting of metals, metal allows and ceramics and combinations thereof, a solid lubricant selected from the group consisting off fluorides, sulfides, and nitrides and combinations thereof and a plastic selected from the group consisting of thermosets and thermoplastics and combinations thereof.

2. The thermal spray powder recited in claim 1, wherein said metal is selected from the group consisting of aluminum, titanium, copper, zinc, nickel, chromium, iron, cobalt and silicon.

3. The thermal spray powder recited in claim 1, wherein said metal alloy is selected from the group consisting of alloys of the metals, aluminum, titanium, copper, zinc, nickel, chromium, iron, cobalt, and silicon.

4. The thermal spray powder recited in claim 1, wherein said ceramic is selected from the group consisting of oxides of aluminum, titanium, fully or partially stabilized zirconia, silicon, and combinations thereof.

5. The thermal spray powder recited in claim 1, wherein said ceramic is a phosphate.

6. The thermal spray powder recited in claim 1, wherein said ceramic is a spinel.

7. The thermal spray powder recited in claim 1, wherein said ceramic is a perovskite.

8. The thermal spray powder recited in claim 1, wherein said ceramic is a machinable ceramic.

9. The thermal spray powder recited in claim 1, wherein solid lubricant is a fluoride selected from the group consisting of $CaF_2$, $MgF_2$, $BaF_2$, and combinations thereof.

10. The thermal spray powder recited in claim 1, wherein said fluoride is a fluoride eutectic.

11. The thermal spray powder in claim 1, wherein said solid lubricant is $MoS_2$.

12. The thermal spray powder recited in claim 1, wherein said plastic is a polyimide.

13. The thermal spray powder recited in claim 12, wherein said plastic is a thermoplastic polyimide.

14. The thermal spray powder recited in claim 1, wherein said plastic is a polyamide-imide.

15. The thermal spray powder recited in claim 1, wherein said plastic is a polyether-imide.

16. The thermal spray powder recited in claim 1, wherein said plastic is a bismaleimide.

17. The thermal spray powder recited in claim 1, wherein said plastic is a fluoroplastic.

18. The thermal spray powder recited in claim 17, wherein said fluoroplastic is selected from the group consisting of PTFE, FET and PFA.

19. The thermal spray powder recited in claim 1, wherein said plastic is a ketone-based resin.

20. The thermal spray powder recited in claim 1, wherein said plastic is a polyester.

21. The thermal spray powder recited in claim 1, wherein said plastic is a liquid crystal polymer.

22. The thermal spray powder recited in claim 1, wherein said matrix-forming component comprises from about 5 to about 90 percent by weight of said thermal spray powder.

23. The thermal spray powder recited in claim 1, wherein said solid lubricant comprises from about 1 to about 50 percent by weight of said thermal spray powder.

24. The thermal spray powder recited in claim 1, wherein said plastic comprises from about 5 to about 90 percent by weight of said thermal spray powder.

25. The thermal spray powder recited in claim 1, wherein said powder includes agglomerated particles containing said matrix-forming component, said solid lubricant and said plastic.

26. The thermal spray powders recited in claim 25, wherein said agglomerated particles are mechanically fused agglomerates.

27. A method of forming a thermal spray powder comprising the steps of:

combining a matrix-forming component selected from the group consisting of metals, metal alloys and ceramics and combinations thereof, a solid lubricant selected from the group consisting of fluorides, sulfides, and nitrides and combinations thereof and a plastic selected from the group consisting of thermosets and thermoplastics and combinations thereof in a vessel; and agglomerating said matrix-forming component, said solid lubricant and said plastic together to form agglomerated particles.

28. The method recited in claim 27, wherein said agglomerating step is mechanical agglomeration.

29. A method of forming an abradable coating comprising the steps of:

providing a powder having a matrix-forming component selected from the group consisting of metals, metal alloys and ceramics and combinations thereof, a solid lubricant selected from the group consisting of fluorides, sulfides, and nitrides and combinations thereof and a plastic selected from the group consisting of thermosets and thermoplastics and combinations thereof;

heating and accelerating said powder toward a substrate with a thermal spray gun to form a deposit on said substrate;

allowing said substrate to cool on said substrate forming a coating; and removing said plastic from said coating to form an abradable porous structure.

30. The method recited in claim 29, wherein said thermal spray gun is a flame spray gun.

31. The method recited in claim 29, wherein said thermal spray gun is a plasma spray gun.

32. An abradable material, comprising:

a substantially continuous matrix, said matrix being formed of a material selected from the group consisting of metals, metal alloys, and ceramics;

solid lubricant inclusions dispersed throughout said matrix, said solid lubricant inclusions being selected from the group consisting of fluorides, sulfides and nitrides, and combinations thereof; and plastic inclusions dispersed throughout said matrix, said plastic inclusions being selected from the group consisting of thermosets and thermoplastics and combinations thereof.

33. The invention recited in claim 32, wherein said abradable material is a coating on a substrate.

34. The invention recited in claim 33, wherein said substrate is an engine shroud and said coating is an abradable seal.

35. The invention recited in claim 34, wherein said substrate is a compression housing and said coating is an abradable seal.

36. The invention recited in claim 33, wherein said lubricant is boron nitride.

37. The invention recited in claim 32, wherein said solid lubricant is a fluoride selected from the group consisting of $CaF_2$, $MgF_2$, $BaF_2$ and combinations thereof.

38. The invention recited in claim 32, wherein said thermoplastic is selected from the group consisting of polyimides and polyesters.

39. The invention recited in claim 32, wherein said plastic is selected from the group consisting of fluoroplastics, ketone-based resins, and liquid crystal polymers.

40. The invention recited in claim 32, wherein said matrix comprises from about 5 to about 90 percent by weight of said material, said solid lubricant comprises from about 1 to about 50 percent by weight of said material, and said plastic comprises from about 5 to about 90 percent by weight of said material.

41. The method of forming an abradable coating recited in claim 29, wherein said plastic is removed by vaporizing the plastic.

42. The method of forming an abradable coating recited in claim 29, wherein said plastic is removed by oxidizing the plastic.

* * * * *